US007210991B1

(12) United States Patent
Van Der Veen et al.

(10) Patent No.: US 7,210,991 B1
(45) Date of Patent: May 1, 2007

(54) DETACHABLE RETAINING RING

(75) Inventors: Shaun Van Der Veen, San Jose, CA (US); Hung Chih Chen, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/396,839

(22) Filed: Apr. 3, 2006

(51) Int. Cl.
*B24B 29/00* (2006.01)

(52) U.S. Cl. ..... 451/285; 451/41; 451/398

(58) Field of Classification Search ..... 451/41, 451/9–11, 388, 285–289, 397, 398
See application file for complete search history.

(56) References Cited

U.S. PATENT DOCUMENTS

| | | | |
|---|---|---|---|
| 5,993,302 | A | 11/1999 | Chen et al. |
| 6,159,079 | A | 12/2000 | Zuniga et al. |
| 6,183,354 | B1 | 2/2001 | Zuniga et al. |
| 6,419,567 | B1 | 7/2002 | Glashauser |
| 6,533,646 | B2 | 3/2003 | Volodarsky |
| 6,645,057 | B2 | 11/2003 | Quek |
| 6,705,932 | B1 | 3/2004 | Zuniga et al. |
| 6,746,313 | B1 | 6/2004 | Pham et al. |
| 6,866,571 | B1 | 3/2005 | Held |
| 6,890,249 | B1 | 5/2005 | Zuniga et al. |
| 6,913,669 | B2 | 7/2005 | Ensinger |
| 6,932,679 | B2 | 8/2005 | Telieh et al. |
| 6,974,371 | B2 | 12/2005 | Chen et al. |
| 2003/0114087 | A1 | 6/2003 | Duboust et al. |
| 2005/0037598 | A1 | 2/2005 | Zuniga et al. |
| 2005/0126708 | A1 | 6/2005 | Chen et al. |
| 2005/0142993 | A1 | 6/2005 | Chen et al. |
| 2005/0211377 | A1 | 9/2005 | Chen et al. |
| 2005/0282322 | A1 | 12/2005 | Manens et al. |

*Primary Examiner*—Dung Van Nguyen
(74) *Attorney, Agent, or Firm*—Patterson and Sheridan

(57) ABSTRACT

The present invention relates to an apparatus and method for polishing semiconductor substrates with improved throughput. Embodiments of the present invention eliminate load cups from a polishing system, hence improve throughput by reducing system footprint and substrate hand off. One embodiment provides an apparatus for polishing a substrate. The apparatus comprises a platen having a polishing pad supported thereon, a carrier head configured to hold the substrate and press the substrate against the polishing pad, and a retaining ring adapted to be attached to and detached from the carrier head, wherein the retaining ring is configured to receive the substrate while positioned on the polishing pad and detached from the carrier head.

20 Claims, 13 Drawing Sheets

DETACHABLE RETAINING RING

BACKGROUND OF THE INVENTION

1. Field of the Invention

Embodiments of the invention generally relate to an apparatus and method for polishing or planarization of semiconductor substrates.

2. Description of the Related Art

Sub-micron multi-level metallization is one of the key technologies for the next generation of ultra large-scale integration (ULSI). The multilevel interconnects that lie at the heart of this technology require planarization of interconnect features formed in high aspect ratio apertures, including contacts, vias, trenches and other features. Reliable formation of these interconnect features is very important to the success of ULSI and to the continued effort to increase circuit density and quality on individual substrates and die.

In the fabrication of integrated circuits and other electronic devices, multiple layers of conductive, semiconductive, and dielectric materials are deposited on or removed from a surface of a substrate. Thin layers of conductive, semiconductive, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electro-chemical plating (ECP).

As layers of materials are sequentially deposited and removed, the uppermost surface of the substrate may become non-planar across its surface and require planarization. An example of non-planar process is the deposition of copper films with the ECP process in which the copper topography simply follows the already existing non-planar topography of the wafer surface, especially for lines wider than 10 microns. Planarizing a surface, or "polishing" a surface, is a process where material is removed from the surface of the substrate to form a generally even, planar surface. Planarization is useful in removing undesired surface topography and surface defects, such as rough surfaces, agglomerated materials, crystal lattice damage, scratches, and contaminated layers or materials. Planarization is also useful in forming features on a substrate by removing excess deposited material used to fill the features and to provide an even surface for subsequent levels of metallization and processing.

Planarization is generally performed using Chemical Mechanical Polishing (CMP) and/or Electro-Chemical Mechanical Deposition (ECMP). A planarization method typically requires that the substrate be mounted in a carrier head, with the surface of the substrate to be polished exposed. The substrate supported by the head is then placed against a rotating polishing pad. The head holding the substrate may also rotate, to provide additional motion between the substrate and the polishing pad surface. Further, a polishing composition is supplied to the pad to provide an chemical solution at the interface between the pad and the substrate.

Existing polishing tools generally include loading stations configured for robots and polishing heads to drop off and pick up substrates. There are several disadvantages for the loading stations. First, the loading stations increase overall footprint for the polishing tool, therefore, require extra space in a cleanroom which is expensive to maintain. Second, since the polishing heads are dependent on the loading stations, system flexibility is greatly weakened, especially in polishing systems with multiple polishing heads. Third, using loading stations increases substrate hand off which is a source of particle contamination.

Therefore, there is a need for an apparatus and method to eliminate loading stations.

SUMMARY OF THE INVENTION

The present invention provides methods and apparatus for polishing a semiconductor substrate.

One embodiment provides an apparatus for polishing a substrate. The apparatus comprises a platen having a polishing pad supported thereon, a carrier head configured to hold the substrate and press the substrate against the polishing pad, and a retaining ring adapted to be attached to and detached from the carrier head, wherein the retaining ring is configured to receive the substrate while positioned on the polishing pad and detached from the carrier head.

Another embodiment of the present invention provides a method for polishing a substrate. The method comprises positioning a retaining ring on a polishing pad, positioning the substrate into a recess defined by the retaining ring and the polishing pad, moving a carrier head to engage the retaining ring, loading the substrate on a substrate mounting surface of the carrier head, and polishing the substrate by rotating the substrate against the polishing pad using the carrier head.

Yet another embodiment of the present invention provides a method for loading a substrate on a carrier head. The method comprises positioning a retaining ring on a supporting surface, positioning the substrate into a recess defined by the retaining ring and the supporting surface, moving the carrier head to engage the retaining ring, and securing the substrate on a substrate mounting surface of the carrier head.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention provides methods and apparatus for polishing semiconductor substrates. Polishing systems of the present invention generally comprise a detachable retaining ring which may be detached from a carrier head during loading and unloading of a substrate and attached to the carrier head during polishing. During polishing, the detachable retaining ring may rotate at the same speed as the substrate, retaining the substrate within its inner surface and keep the polishing pad near the edge of the substrate flat to achieve an uniform polishing. A robot may load a substrate into the detachable retaining ring when it is detached from the carrier head and secured on a supporting surface, for example, a polishing pad, therefore, eliminating the needs for a load cup. For a polishing system with multiple polishing stations and/or multiple polishing heads, multiple detachable retaining rings may be used and each of the multiple detachable retaining rings may be dedicated to a polishing station or a carrier head.

Figure 1A:
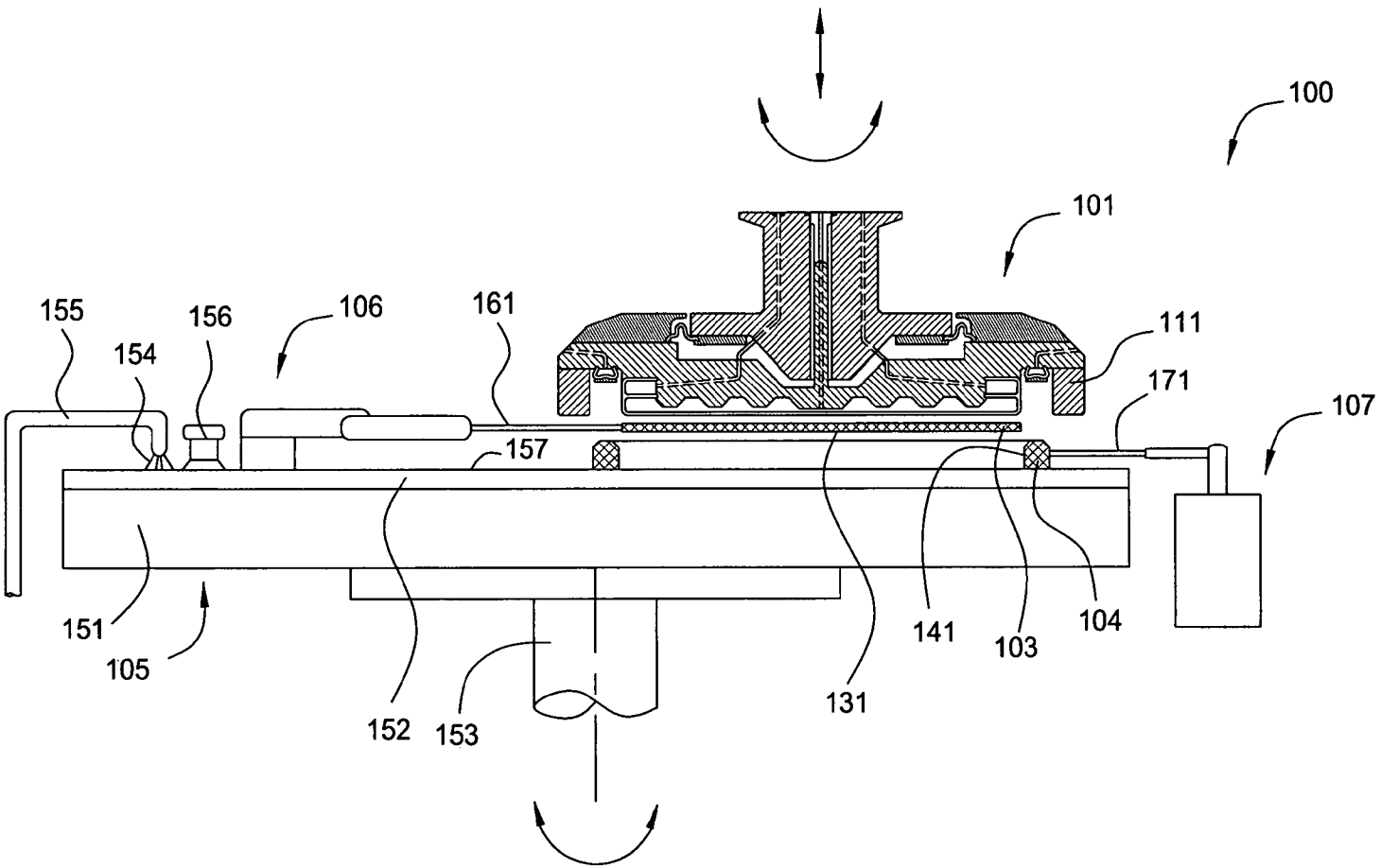
FIG. 1A illustrates an polishing system in accordance with one embodiment of the present invention.

FIG. 1A illustrates a perspective view of a polishing system 100 in accordance with one embodiment of the present invention. One polishing tool that may be adapted to benefit from the present invention is polishers available from Applied Materials, Inc. of Santa Clara, Calif. Other polishing tools that may be adapted to benefit from the invention include MIRRA®, MIRRA MESA®, REFLEXION®, REFLEXION® LK, and REFLEXION LK Ecmp™ Planarizing Systems, all available from Applied Materials, Inc. of Santa Clara, Calif.

The polishing system 100 generally comprises a carrier head 101, a polishing station 105, a detachable retaining ring 104, and a ring holder 107. In one embodiment, the polishing system 100 may be a stand alone polishing system. In another embodiment, the polishing system 100 belongs to a polishing system comprising multiple polishing stations and multiple carrier heads. For example, the polishing station 105 may be disposed on a system base having multiple platens and the carrier head 101 may be supported by a rotatable carousel having multiple carrier heads identical or similar to the carrier heads 101. A detailed description of a polishing system may be found in U.S. Pat. No. 5,804,507, entitled "Radially Oscillating Carousel Processing System for Chemical Mechanical Polishing", U.S. patent application Ser. No. 10/211,626, entitled "Contacts for Electrochemical Processing", and U.S. patent application, entitled "Six Headed Carousel", which are herein incorporated by reference.

The polishing station 105 generally comprises a rotatable platen 151 on which a polishing pad 152 is placed. The rotatable platen 151 and the polishing pad 152 are generally larger than a substrate 103 being processed. For example, if the substrate 103 is an eight inch (200 mm) diameter disk, the platen 151 and the polishing pad 152 are about 20 inches in diameter. If the substrate 103 is a twelve inch (300 mm) diameter disk, the platen 151 and the polishing pad 152 are about 30 inches in diameter. In one embodiment, the platen 151 is a rotatable aluminum or stainless steel plate connected by a stainless steel drive shaft 153 to a platen drive motor (not shown). For most polishing processes, the platen drive motor rotates the platen 151 at about thirty to two hundred revolutions per minute, although lower or higher rotational speeds may be used.

The polishing pad 152 has a roughened polishing surface 157 configured to polish the substrate 103 using a chemical mechanical polishing (CMP) method or an electrical chemical mechanical polishing (ECMP) method. In one embodiment, the polishing pad 152 may be attached to the platen 151 by a pressure-sensitive adhesive layer. The polishing pad 152 is generally consumable and may be replaced. A detailed description of a polishing pad may be found in U.S. Pat. No. 6,991,528, entitled "Conductive Polishing Article for Electrochemical Mechanical Polishing", which is herein incorporated by reference.

The polishing station 105 may further comprise a polishing composition supplying tube 155 configured to provide sufficient polishing composition 154 to cover and wet the entire polishing pad 152. The polishing composition 154 generally contains a reactive agent, e.g. deionized water for oxide polishing, abrasive particles, e.g., silicon dioxide for oxide polishing, and a chemical-reactive catalyzer, e.g., potassium hydroxide for oxide polishing.

The polishing station 105 may further comprise a pad conditioner 156 configured to maintain the condition of the polishing pad 152 so that it will effectively polish any substrate pressed against it. In one embodiment, the pad conditioner 156 may comprise a rotatable arm holding an independently rotating conditioner head and an associated washing basin.

In another embodiment, the platen 151 may be replaced by a polishing structure having a belt pad made of CMP or ECMP materials.

Figure 1B:
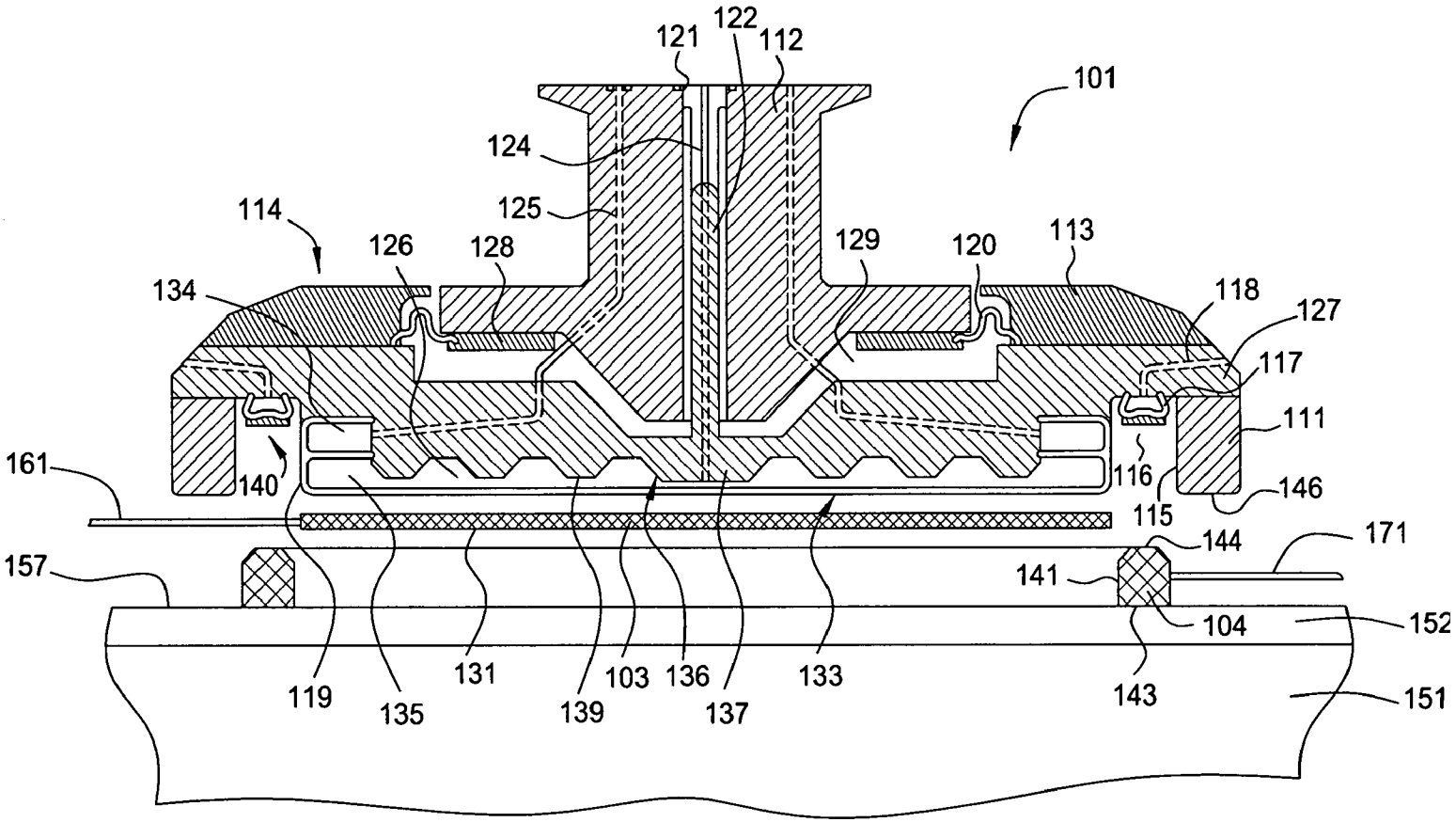
FIG. 1B illustrates a partially enlarged view of the polishing system of FIG. 1A.

The carrier head 101 is generally configured to hold the substrate 103 against the polishing pad 152 during polishing and evenly distribute a downward pressure across the back surface of the substrate 103. One embodiment of the carrier head 101 is illustrated in FIG. 1B which is FIG. 1A partially enlarged.

The carrier head 101 generally comprises a housing 112, a base assembly 114, a loading chamber 129, an outer retaining ring 111, and a retaining ring engaging assembly 140. A description of a similar carrier head may be found in U.S. Pat. No. 6,183,354, entitled "Carrier Head with Flexible Membrane for Chemical Mechanical Polishing", and U.S. patent application Ser. No. 11/054,128, filed on Feb. 8, 2005, entitled "Multiple-Chamber Carrier Head with a Flexible Membrane", which are incorporated herein by reference.

The housing 112 is generally circular in shape and can be connected to a drive shaft (not shown) to rotate and or sweep therewith during polishing. A vertical bore 121 may be formed through the housing 112, and passages 124 and 125 may extend through the housing 112 for pneumatic control of the carrier head.

The base assembly 114 is a vertically movable assembly located beneath the housing 112. The base assembly 114 comprises a generally rigid annular body 127, an outer clamp ring 113, and a gimbal mechanism 136. The gimbal mechanism 136 comprises a gimbal rod 122 which slides vertically the along bore 121 to provide a vertical motion of the base assembly 114, and a flexure ring 137 which bends to permit the base assembly 114 to pivot with respect to the housing 112 so that the outer retaining ring 111 and the detachable retaining ring 104 (will be described later) may remain substantially parallel with the polishing surface 157 of the polishing pad 152.

The loading chamber 129 is located between the housing 112 and the base assembly 114 to apply a load, i.e., a downward pressure or weight, to the base assembly 114. The vertical position of the base assembly 114 relative to the polishing pad 152 is also controlled by the loading chamber 129. An inner edge of a generally ring-shaped rolling diaphragm 120 may be clamped to the housing 112 by an inner clamp ring 128. An outer edge of the rolling diaphragm 120 may be clamped to the base assembly 114 by the outer clamp ring 113.

The outer retaining ring 111 may be a generally annular ring secured at the outer edge of the base assembly 114. The bottom surface 139 may be substantially flat with multiple recesses 126 configured for vacuum chuck a substrate. When fluid is pumped into the loading chamber 129 and the base assembly 114 is pushed downwardly, the outer retaining ring 111 is also pushed downwardly to apply a load to the polishing pad 152. A bottom surface 146 of the outer retaining ring 111 may be substantially flat, or it may have a plurality of channels to facilitate transport of polishing composition from outside the outer retaining ring 111 to the substrate.

A flexible membrane 119 is generally clamped on a bottom surface 139 of the base assembly 114. The flexible membrane 119 and the base assembly 114 may form multiple chambers, for example, chambers 134 and 135, which apply pressure or generate vacuum between the flexible membrane 119 and a backside of the substrate 103 to engage the substrate 103. In one embodiment, the chambers 134 and 135 may be inflated and deflated through the passages 125 and 124 respectively.

The detachable retaining ring 104 may be engaged by a plurality of methods, for example by pressure, friction, dowel pins, and electromagnetic approach. In one embodiment, the retaining ring engaging assembly 140 is used. The retaining ring engaging assembly 140 is generally a circular structure attached to the base assembly 114 inside the outer retaining ring 111 and outside the flexible membrane 119. The retaining ring engaging assembly 140 is configured to engage the detachable retaining ring 104 and transfer torque from the carrier head 101 to the detachable retaining ring 104. In one embodiment, the retaining ring engaging assembly 140 comprises a bladder 117 clamped on the rigid annular body 127. The bladder 117 may be inflated and deflated via a passage 118. An engaging member 116 is generally attached to the bladder 117. The engaging member 116 configured to engage the detachable retaining ring 104 by an upper surface 144 of the detachable retaining ring 104.

The detachable retaining ring 104 is a generally annular ring adapted to be attached to the retaining ring engaging assembly 140 of the carrier head 101. The detachable retaining ring 104 may be pushed downwardly by the carrier head 101 or the ring holder 107 to apply a load to the polishing pad 152. A bottom surface 143 of the detachable retaining ring 104 may be substantially flat, or it may have a plurality of channels to facilitate transport of polishing composition from the outer retaining ring 111 to the substrate 103. An inner surface 141 of the detachable retaining ring 104 engages the substrate to prevent it from escaping. In one embodiment, the inner surface 141 may be tapered near the upper surface 144 to increase a tolerance for loading the substrate 103. In another embodiment, an outer surface 142 of the detachable retaining ring 104 and/or an inner surface 115 of the outer retaining ring 111 may also be tapered for easy attaching.

Referring back to FIG. 1A, the ring holder 107 may be positioned near the polishing station 105. The ring holder 107 is configured to grasp the detachable retaining ring 104 when it is detached and to position the detachable retaining ring 104 in a predetermined location so that a robot assembly 106 may drop a substrate within the inner surface 141 of the detachable retaining ring 104. In one embodiment, the ring holder 107 may comprise a gripper 171 configured to hold the detachable retaining ring 104 by the outer surface 142. In one embodiment, the ring holder 107 may also apply a downwardly force to the detachable retaining ring 104 to prevent a substrate retained therein from escaping, especially when the platen 1511 is rotating. In another embodiment, the ring holder 107 is also configured to remove the detachable retaining ring 104 from the polishing pad 152 when the polishing pad 152 is maintained and/or replaced. The ring holder 107 may also be capable of transferring the detachable retaining ring 104 to a wash station for cleaning.

FIG. 1A illustrates the polishing system 100 in a substrate loading position. The carrier head 101 is in an up position. The detachable retaining ring 104 is detached from the carrier head 101 and is disposed in a designated location by the ring holder 107. In one embodiment, the platen 151 and the polishing pad 152 may maintain a rotating movement for a higher throughput. In this case, the ring holder 107 also prevent the detachable retaining ring 104 from drifting away from the designated location. The robot assembly 106 transfers the substrate 103 by holding the substrate 103 with an end effecter 161, for example, a gripper. The substrate 103 is transferred by the robot assembly 106 to a position above the detachable retaining ring 104 where the end effecter 161 drops the substrate 103 onto a recess defined by the inner surface 141 of the detachable retaining ring 104 and the polishing pad 152.

Figure 2:
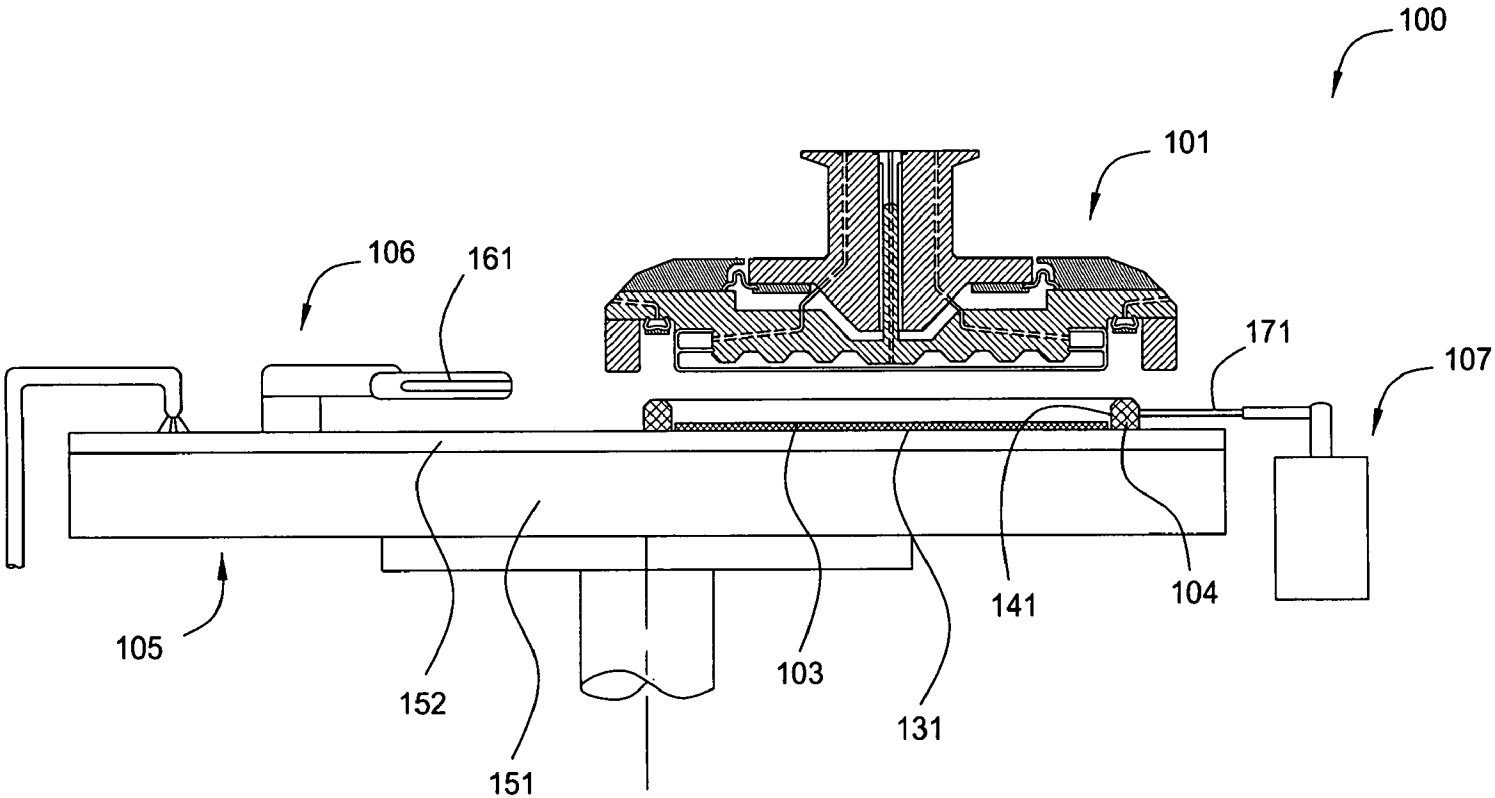
FIG. 2 illustrates the polishing system of FIG. 1A having a substrate retained in a detachable retaining ring.

As shown in FIG. 2, the substrate 103 is dropped onto the polishing pad 152 and within the inner surface 141 of the detachable retaining ring 104 with a polishing surface 131 facing the polishing pad 152. The robot assembly 106 retracts allowing the carrier head 101 to lower down and perform polishing to the substrate 103.

Figure 3A:
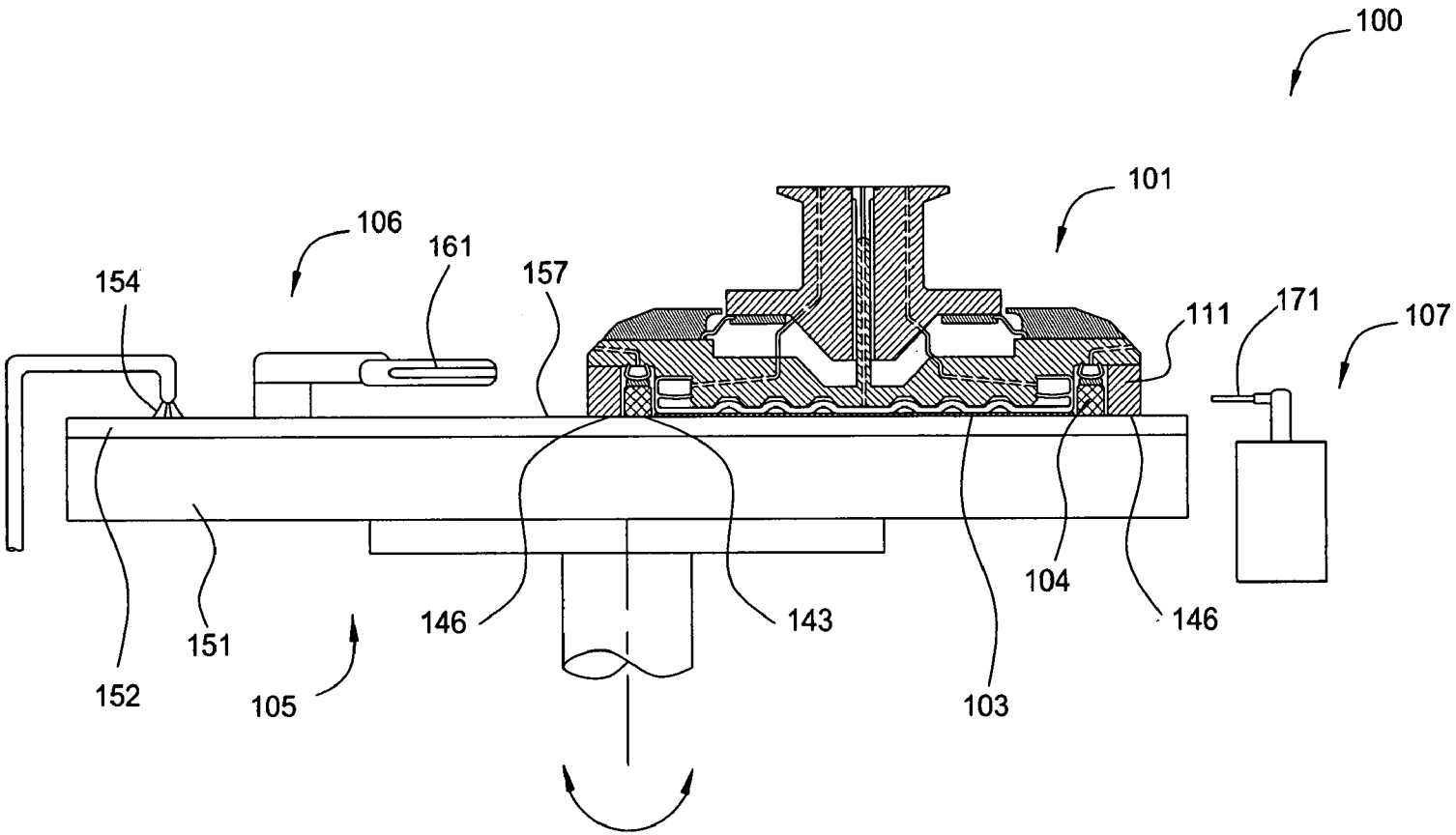
FIG. 3A illustrates the polishing system of FIG. 1A in a polishing position.
Figure 3B:
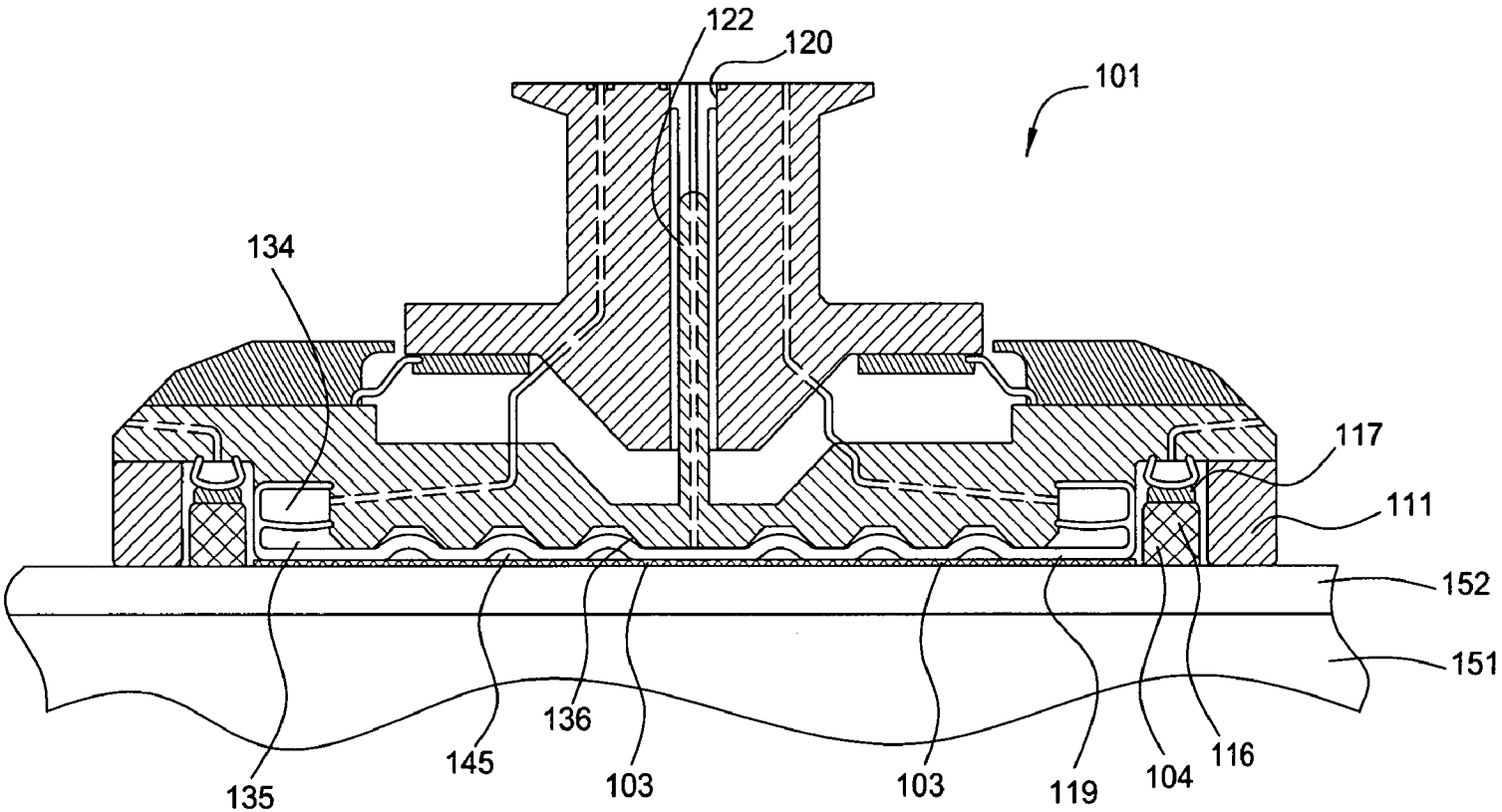
FIG. 3B is a partially enlarged view of FIG. 3A.

FIG. 3A illustrates the polishing system 100 of FIG. 1A in a polishing position. In the polishing position, the carrier head 101 lowers down and the ring holder 107 retracts so that the detachable retaining ring 104 is attached to the carrier head 101. FIG. 3B is a partially enlarged view of FIG. 3A. As shown in FIG. 3B, the carrier head 101 is in a lowered position that the outer retaining ring 111 is in contact with the polishing pad 152. The bladder 117 is inflated to apply a downward force to the polishing pad 152 through the attached detachable retaining ring 104. The amplitude of the downward force may be adjusted by the pressure inside the bladder 117. In one embodiment, the engaging member 116 may engage the detachable retaining ring with friction and the downward force from the bladder 117 provides a pressure to enable the friction which may be large enough to transfer torque from the carrier head 101 to the detachable retaining ring 104 so that the detachable retaining ring 104 rotates at the same speed as the carrier head 101. During polishing, the substrate 103 is generally rotated by the carrier head 101 and pushed against the polishing pad 152 by the carrier head 101. To rotate the substrate 103, the carrier head 101 must secure the substrate 103 by generating vacuum pouches 145 between a backside of the substrate 103 and the flexible membrane 119. In one embodiment, the vacuum pouches 145 are generated by first pressing the substrate 103 with the chamber 135 of the flexible membrane 119 inflated to eliminate the air between the substrate 103 and the flexible membrane, and then deflating the chamber 135 while inflating the chamber 134.

Figure 4:
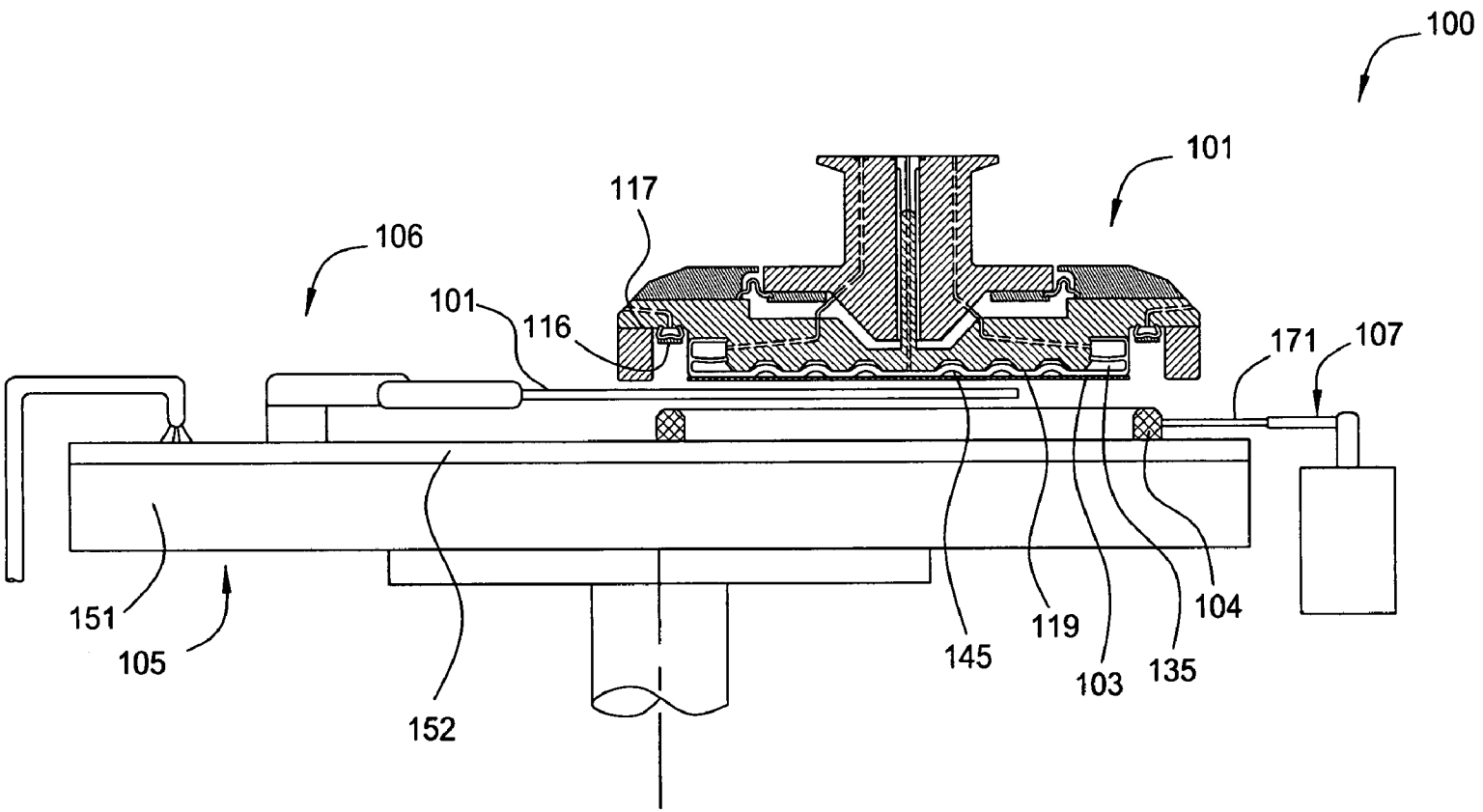
FIG. 4 illustrates the polishing system of FIG. 1A in a substrate unloading position.

FIG. 4 illustrates the polishing system 100 of FIG. 1A in a substrate unloading position. Generally, after a polishing process is finished, the carrier head 101 releases the detachable retaining ring 104, for example by deflating the bladder 117 and removing the pressure between the engaging member 116 and the detachable retaining ring 104. The carrier head 101 then raises up with the substrate 103 secured on the flexible membrane 119 and leaving the detachable retaining ring 104 on the polishing pad 152. In one embodiment, the gripper 171 of the ring holder 107 comes in to grasp the detachable retaining ring 104 before the carrier head 101 completely releases the detachable retaining ring 104.

In one embodiment, after the detachable retaining ring 104 is released, the end effecter 161 of the robot assembly 106 may come under the carrier head 101 to pick up the substrate 103. In one embodiment, the chamber 135 may be inflated and the vacuum pouches 145 may be eliminated and the substrate 103 is released from the flexible membrane 119. After the substrate 103 is picked up by the robot assembly 106, a new substrate may be loaded into the detachable retaining ring 104 and a new cycle of polishing process may start.

In another embodiment, the carrier head 101 may take the substrate 103 to another polishing station configured to perform a different polishing step to the substrate 103.

Figure 11:
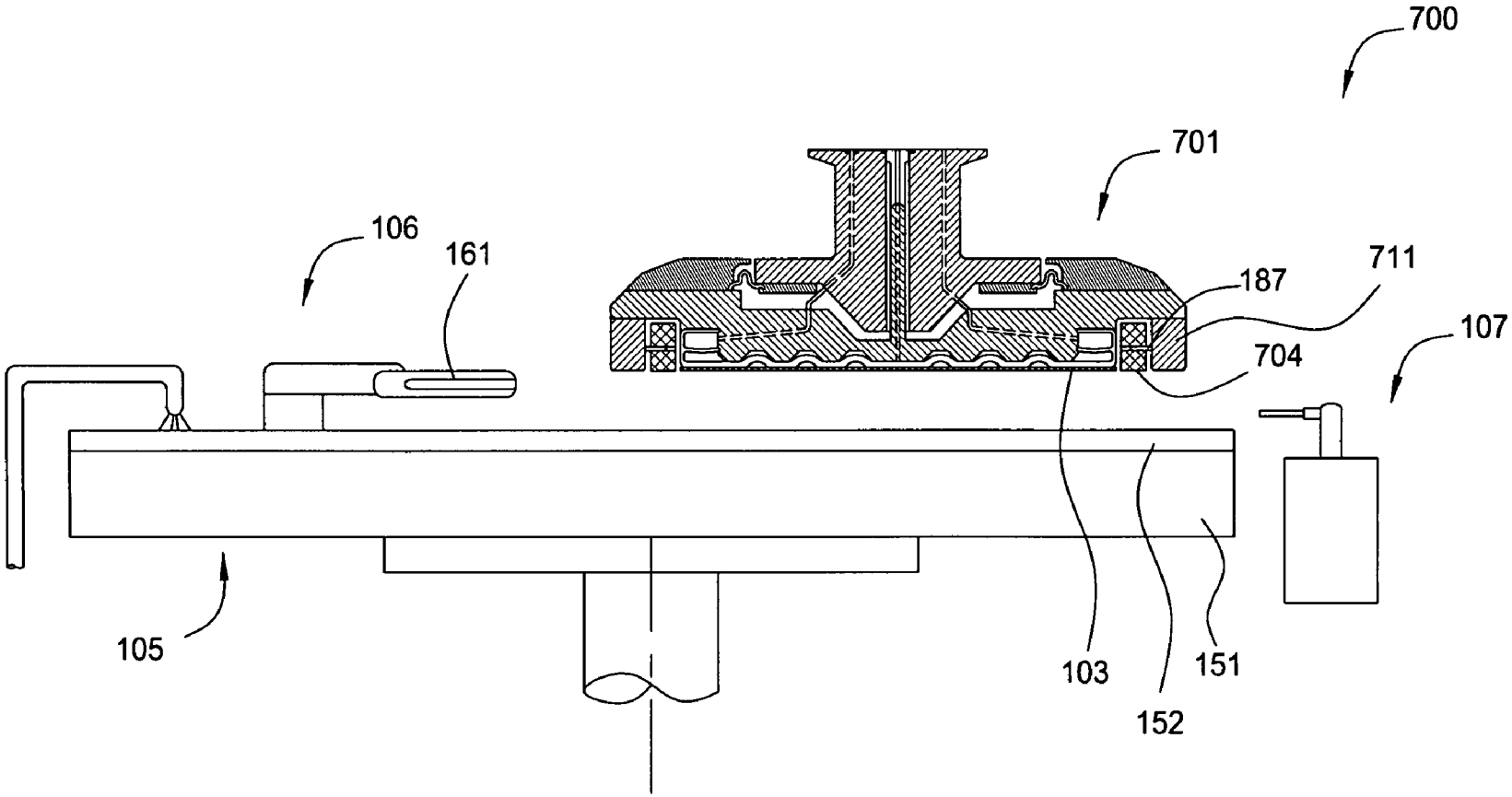
FIG. 11 illustrates a polishing system having a detachable retaining ring dedicated to a carrier head.

As shown in FIGS. 1–4, the detachable retaining ring 104 is dedicated to the polishing station 105. In another embodiment, the detachable retaining ring 104 may also be dedicated to the carrier head 101. In the later configuration, the detachable retaining ring 104 will stay attached to the carrier head 101 and travel with the carrier head 101 in the case of multiple step polishing. The detachable retaining ring 104 is only detached from the carrier head 101 when loading a substrate or cleaning the detachable retaining ring 104. An embodiment of a detachable retaining ring dedicated to a carrier head is shown in FIG. 11 and will be described later.

It should be noted that the method of loading a substrate to a carrier head using a detachable retaining ring may be used in situations other than on a polishing pad, for example, on a cleaning station.

Figure 5:
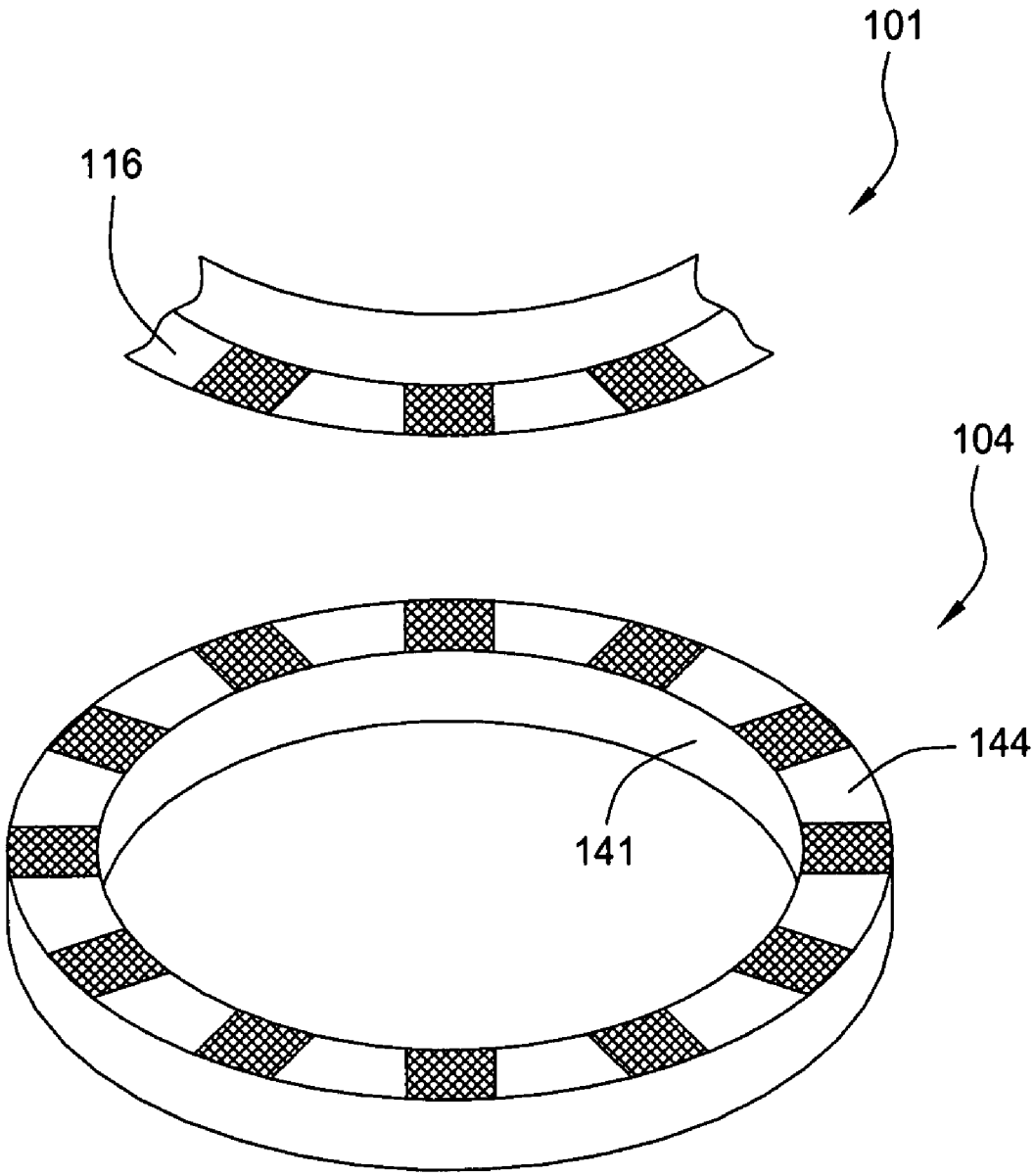
FIG. 5 illustrates a detachable retaining ring in accordance with one embodiment of the present invention.
Figure 6A:
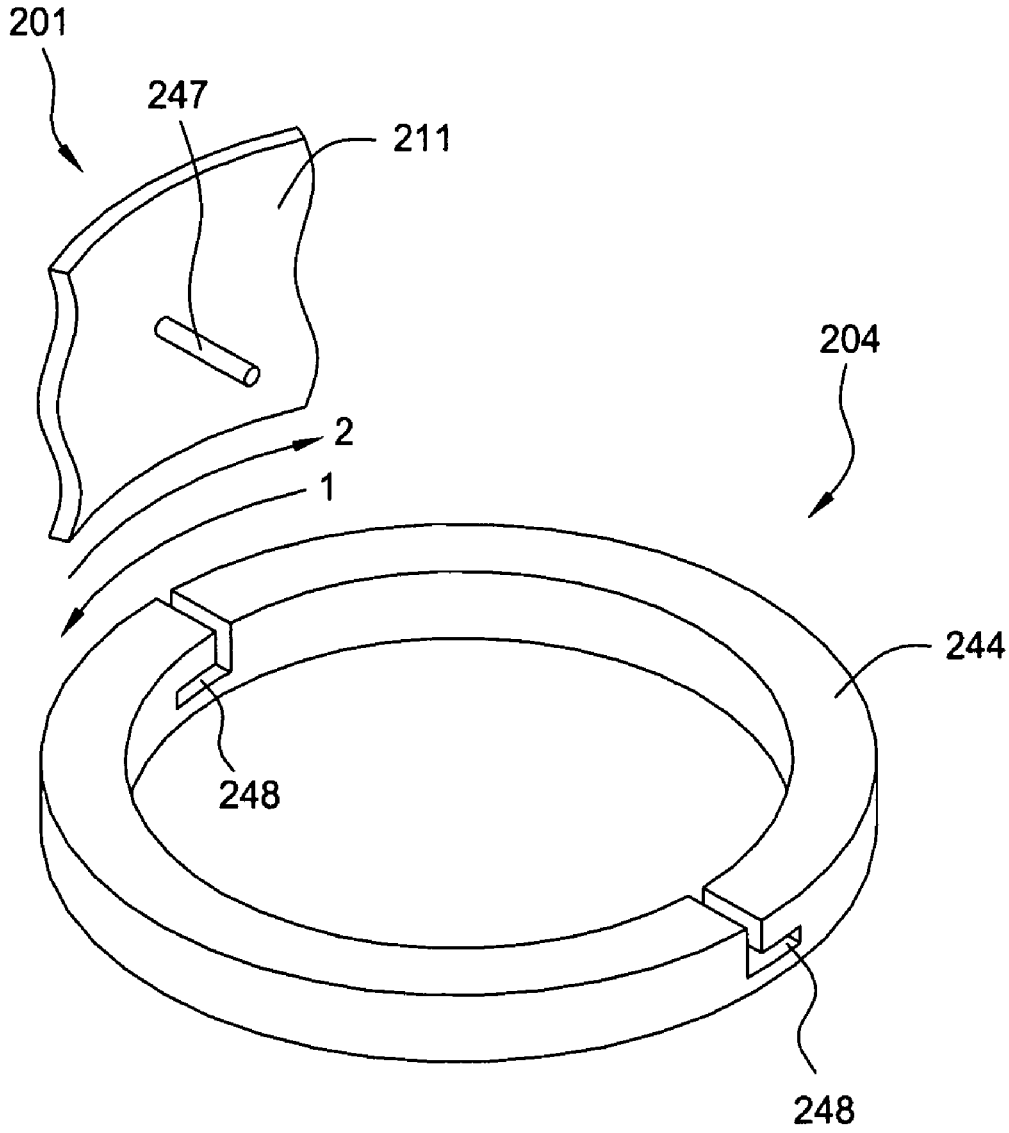
FIG. 6A illustrates a detachable retaining ring in accordance with one embodiment of the present invention.
Figure 6B:
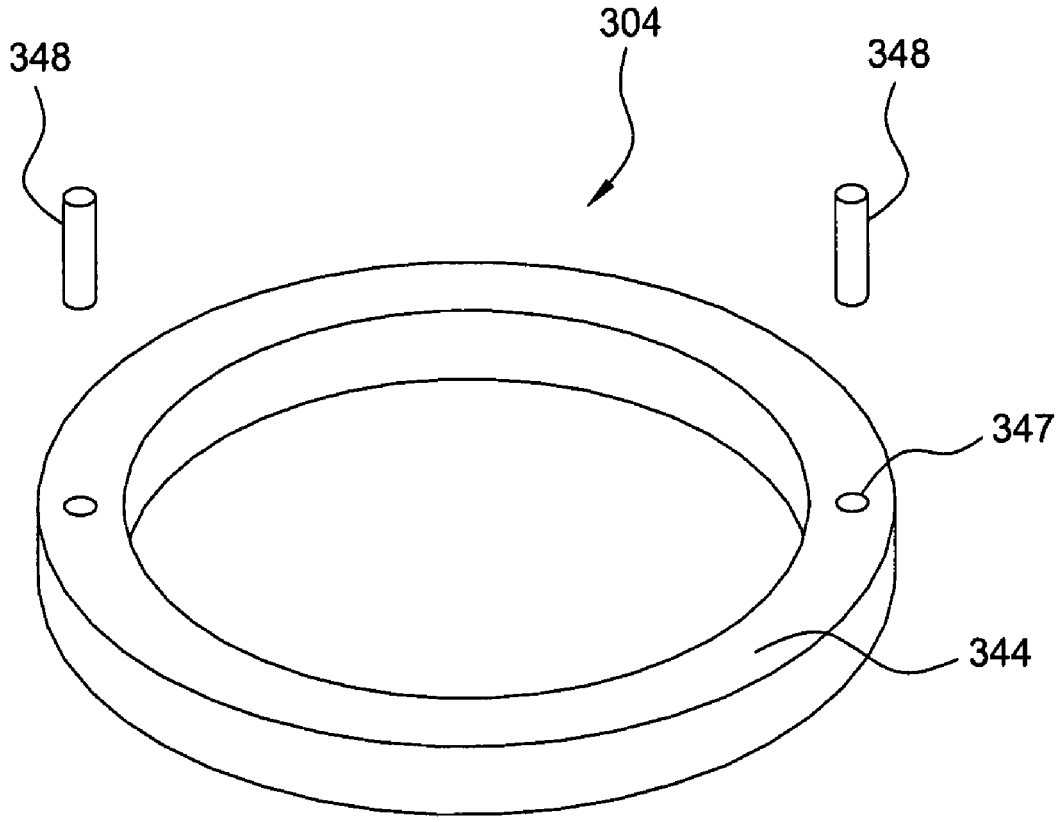
FIG. 6B illustrates a detachable retaining ring in accordance with one embodiment of the present invention.
Figure 7:
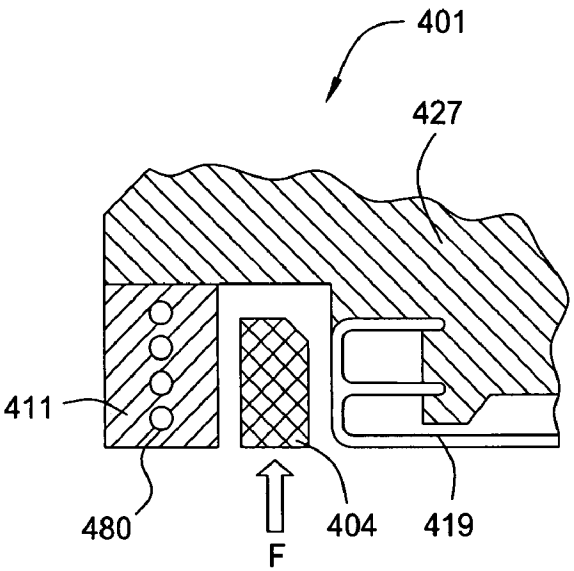
FIG. 7 illustrates one embodiment of lifting a detachable retaining ring in accordance with the present invention.

FIGS. 5–7 illustrate embodiments for attaching a detachable retaining ring to a carrier head and/or transferring torque from the carrier head to the detachable retaining ring.

FIG. 5 illustrates a schematic view of the detachable retaining ring 104 in accordance with the polishing system 100 of FIGS. 1–4. The detachable retaining ring 104 has a generally circular shape with an inner surface 141 configured to confine a substrate therein. An upper surface 144 of the detachable retaining ring 104 comprises a high friction material that provides easy engagement with and form torque transference from part of the carrier head 101. In one embodiment, the engaging member 116 is made of a ring of friction material, for example, a form of roughed plastic. The upper surface 144 may comprise similar friction material as the engaging member 116, or may be a frictional metal or plastic surface. When the bladder 117, shown in FIG. 1B, is inflated, the engaging member 116 moves down and contacts the upper surface 144. Torque transfer between the carrier head 101 and the detachable retaining ring 104 occurs as the bladder 117 is further inflated causing more downforce on the detachable retaining ring 104, and more friction to help lock the engaging member 116 and the upper surface 144 together.

In another embodiment, the bladder 117 shown in FIG. 1B may be made of rubber and may contact the upper surface 144 directly when it inflates. The upper surface 144 may be made of roughened plastic. When the bladder 117 contacts the upper surface 144, the bladder 117 pushes down on the detachable retaining ring 104. This pressure/down force provides a means of torque transfer from the rotating carrier head 101 to the detachable retaining ring 104 which may rotate at the same speed with the carrier head 101.

FIG. 6A illustrates a schematic view of a detachable retaining ring 204 in accordance with one embodiment of the present invention. The detachable retaining ring 204 generally has at least two "L" shaped slots 248 which open to a top surface 244 of the detachable retaining ring 204. Each of the "L" shaped slots 248 are configured to house a dowel pin 247 from a carrier head 201. In one embodiment, the dowel pins 247 may be extending from an outer retaining ring 211 of the carrier head 201. During engaging, the carrier head 201 lowers to insert the dowel pins 247 into entrances of the "L" shaped slots 248. After the dowel pins 247 are inserted into the "L" shaped slots 248, the carrier head 201 may rotate along direction 1 or 2 to transfer torque to the detachable retaining ring 204. To disengage the detachable retaining ring 204 from an attached position, the carrier head 201 may be rotated along direction 2 so that the dowel pins 247 are in line with the entrances of the "L" shaped slots 248, and raise up to remove the dowel pins 247 from the "L" shaped slots 248. To lift up the detachable retaining ring 204, the carrier head 201 may rotate along direction 1 to position the dowel pins 247 deep in the "L" shape slots 248, and then raise up with the detachable retaining ring 204.

FIG. 6B illustrates a detachable retaining ring 304 in accordance with one embodiment of the present invention. The detachable retaining ring 304 has at least two vertical apertures 347 which open to an upper surface 344 of the detachable retaining ring 304. Each of the vertical apertures 347 is configured to hold a vertical dowel pin 348 extending from a carrier head (not shown). The vertical dowel pins 348 may be lowered into the vertical apertures 347 to attach and transfer torque to the detachable retaining ring 304. The vertical dowel pins 348 may be raised up from the vertical apertures 347 to detach the detachable retaining ring 304.

FIG. 7 illustrates a partial sectional view of one embodiment for lifting a detachable retaining ring in accordance with the present invention. A carrier head 401 is partially shown in FIG. 7. The carrier head 401, similar to the carrier head 101 of FIG. 1A, comprise a rigid annular body 427, a flexible membrane 419 configured to secure a substrate, and an outer retaining ring 411. In one embodiment, the outer retaining ring 411 has coils 480 embedded therein. The coils 408 are configured to generate an upward electromagnetic force F when biased. The upward electromagnetic force F may be adjusted to pick up an detachable retaining ring 404 which is at least partially made of metal.

Figure 8A:
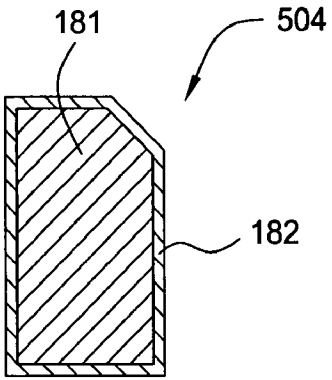
FIG. 8A illustrates a sectional view of a detachable retaining ring in accordance with one embodiment of the present invention.

FIG. 8A illustrates a sectional view of a detachable retaining ring 504 in accordance with one embodiment of the present invention. The detachable retaining ring 504 generally comprises an inner ring 181 and an outer shell 182. The inner ring 181 is configured to provide a rigid structure to the detachable retaining ring 504, and may be formed of a rigid material, such as a metal, for example, stainless steel, molybdenum, or aluminum, or a ceramic, for example, alumina, or other materials. The outer shell 182 may be formed of a material which is chemically inert in a CMP or ECMP process, durable with a low wear rate, and sufficient compressible so that contact of a substrate edge against the detachable retaining ring 504 does not cause the substrate to chip or crack. Suitable materials for the outer shell 182 may be polyphenylene sulfide (PPS), polyetheretherketone (PEEK), carbon filled PEEK, Teflon® filled PEEK, polyethylene therephthalate (PET), polybutylene terephthalate (PBT) polytetrafluoroethylene (PTFE), polybenzimidazole (PBI), polyetherimide (PEI), or a composite material.

Figure 8B:
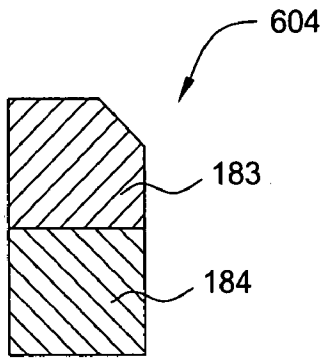
FIG. 8B illustrates a sectional view of a detachable retaining ring in accordance with one embodiment of the present invention.

FIG. 8B illustrates a sectional view of a detachable retaining ring 604 in accordance with one embodiment of the present invention. The detachable retaining ring 604 generally comprises an upper ring 183 and a lower ring 184. The upper ring 183 is attached to the lower ring 184 by various ways, for example by an adhesive layer, fasteners, pressing to fit, or the combination thereof. The upper ring 183 may be formed of a material similar to that for the inner ring 181 of the detachable retaining ring 504. The lower ring 184 may be formed of a material similar to that for the outer shell 182 of the detachable retaining ring 504.

As shown in FIG. 3A, during polishing, the polishing composition 154 supplied to the polishing pad 152 needs to pass the outer retaining ring 111 and the detachable retaining ring 104 to reach the substrate 103. Since both the outer retaining ring 111 and the detachable retaining ring 104 are pressed against the polishing pad 152 to reduce the "edge effect" (a tendency of the substrate edge to be polished at a different rate than the substrate center), a plurality of channels may be formed on the bottom surface 146 of the outer retaining ring 111 and the bottom surface 143 of the detachable retaining ring 104.

Figure 9:
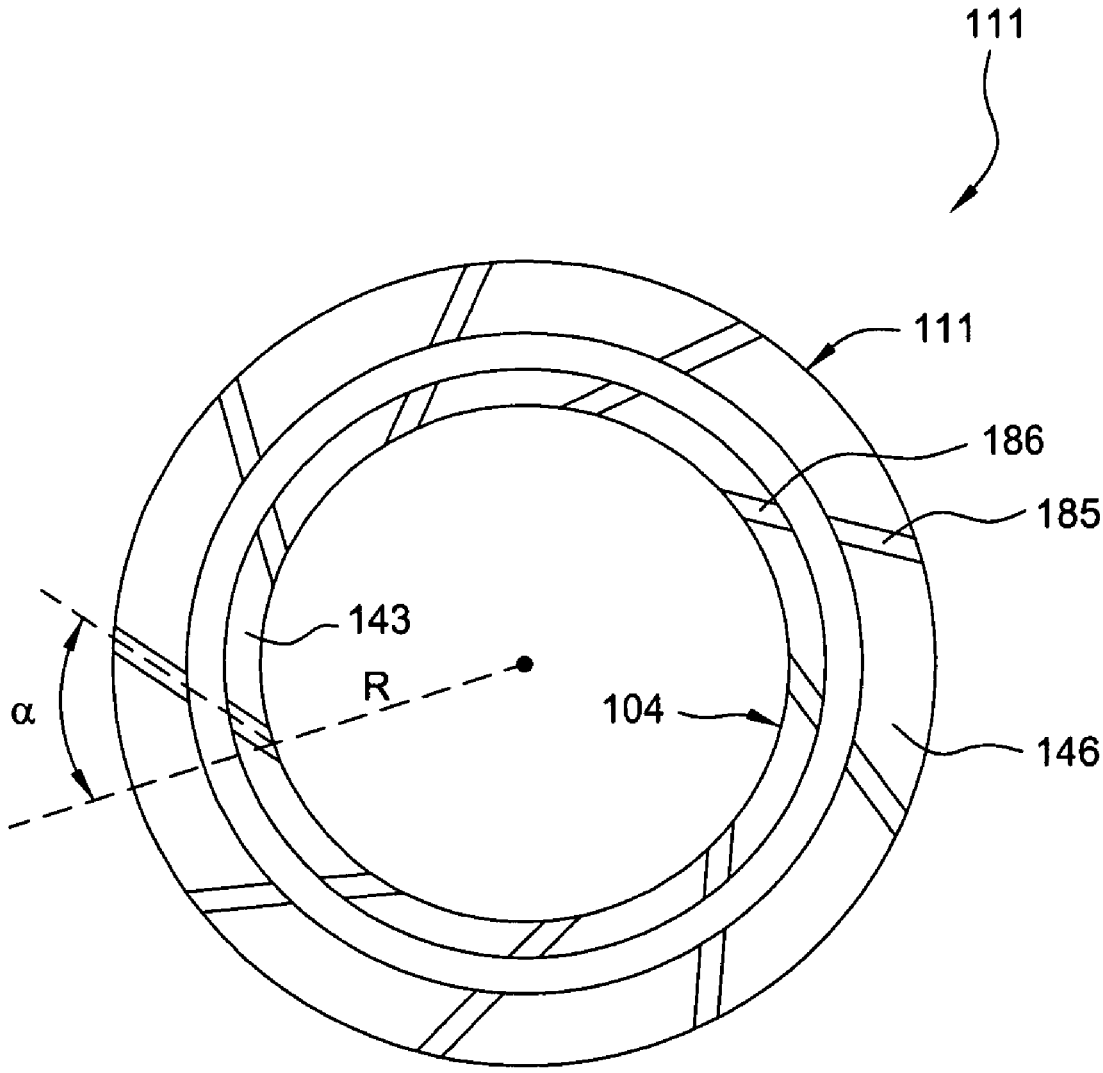
FIG. 9 illustrates a bottom view of a detachable retaining ring and an outer retaining ring in accordance with one embodiment of the present invention.

FIG. 9 illustrates a bottom view of the detachable retaining ring 104 and the outer retaining ring 111 in accordance with one embodiment of the present invention. A plurality of channels 186 are formed on the bottom surface 143 of the detachable retaining ring 104. In one embodiment, the plurality of channels 186 are distributed at equal angular intervals around the detachable retaining ring 104. Each of the plurality of channels 186 may be oriented at an angle $\alpha$, for example 45°, relative to a radial segment R extending through the center of the detachable retaining ring 104. It should be noted that the channels 186 may have other orientation, for example, with the angle $\alpha$ may be between about 30° to about 60°. Similarly, a plurality of channels 185 are formed on the bottom surface 146 of the outer retaining ring 111. The plurality of channels 185 are distributed at equal angular intervals around the outer retaining ring 111. In one embodiment, the channels 185 are oriented at the same angle $\alpha$ as the channels 186 and the number of the channels 186 equals the number of the channel 185. During polishing, the outer retaining ring 111 and the detachable retaining ring 104 may be positioned in such an angle that each of the plurality of channels 186 is aligned with a corresponding channel 185 for easy flow of the polishing composition.

Figure 10A:
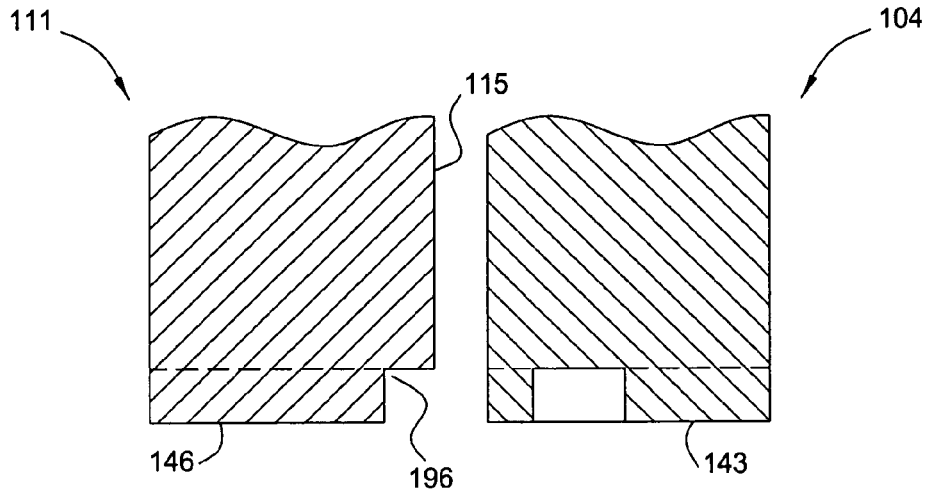
FIG. 10A illustrates a sectional view of a detachable retaining ring and an outer retaining ring in accordance with one embodiment of the present invention.
Figure 10B:
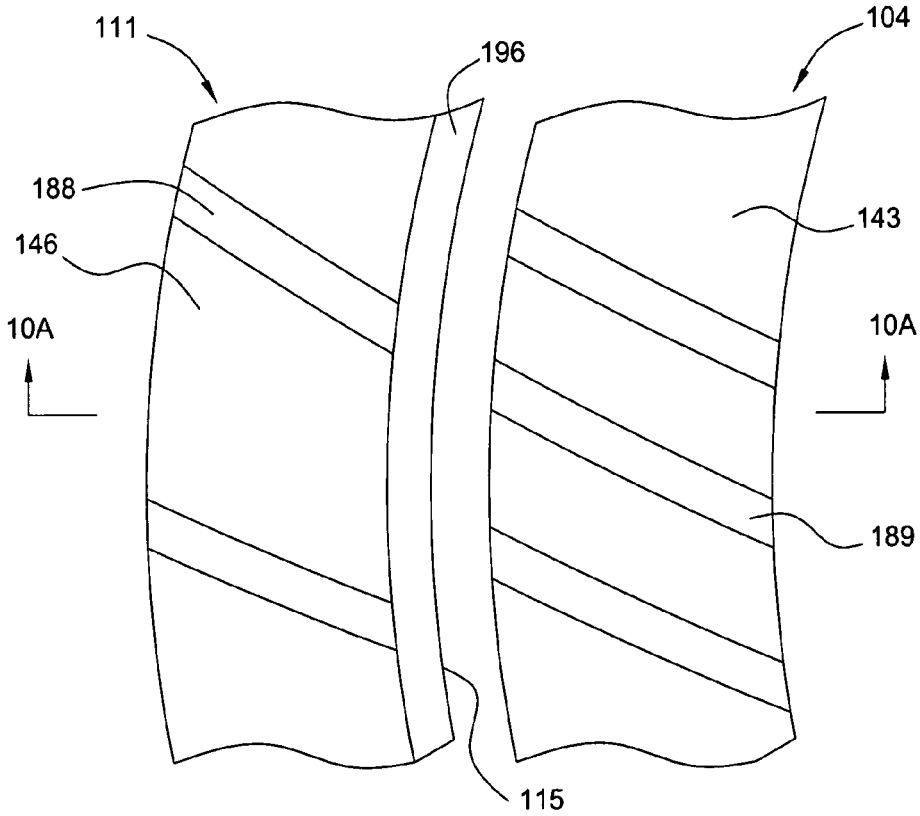
FIG. 10B illustrates a bottom view of the detachable retaining ring and the outer retaining ring of FIG. 10A.

FIG. 10A and FIG. 10B illustrate a sectional view and a bottom view of the detachable retaining ring 104 and the outer retaining ring 111 in accordance with one embodiment of the present invention. In this configuration, radial channels are combined with a circular channel to facilitate polishing composition flow through the outer retaining ring 111 and the detachable retaining ring 104 to a substrate position within the detachable retaining ring 104. A plurality of radial channels 189, similar to the plurality of channels 185 of FIG. 9, are formed on the bottom surface 143 of the detachable retaining ring 104. A plurality of radial channels 188 are formed on the bottom surface 146 of the outer retaining ring 111. A circular channel 196 is formed on the bottom surface 146 and open to the inner surface 115 of the outer retaining ring 111. Each of the plurality of radial channels 188 opens to the circular channel 196. During polishing, polishing solution generally flows through the plurality of radial channels 188 to the circular channel 196, where the polishing solution may be temporarily stored and redistributed to the plurality of radial channels 189 on the detachable retaining ring 104. The circular channel 196 facilitates fluid flow between the outer retaining ring 111 and the detachable retaining ring 104 when the radial channels 189 and 188 are not aligned as shown in FIG. 9. The radial channels 189 and 188 may be different in number and/or in direction.

FIG. 11 illustrates a polishing system 700 having a detachable retaining ring 704 dedicated to a carrier head 701. The carrier head 701 is similar to the carrier head 101 of FIG. 1A, except that the carrier head 701 comprise at least two dowel pins 187 extending from an outer retaining ring 711. The dowel pins 187 are configured to lift up the detachable retaining ring 704 as well as transferring torque to the detachable retaining ring 704. In one embodiment, the detachable retaining ring 704 may be similar to the detachable retaining ring 204 of FIG. 6A. As shown in FIG. 11, after a polishing step is completed in the polishing system 700, the carrier head 701 may raise up with the detachable retaining ring 704 and the substrate 103 and move to another polishing station for another polishing step. The detachable retaining ring 704 may travel with the carrier head 701 in a multi-station polishing system. A multiple step polishing process may particularly benefit from this configuration since it only loads the substrate once and also eliminates load cups in the system.

While the foregoing is directed to embodiments of the present invention, other and further embodiments of the invention may be devised without departing from the basic scope thereof, and the scope thereof is determined by the claims that follow.

What is claimed is:

1. An apparatus for polishing a substrate, comprising:

a platen having a polishing pad supported thereon;

a carrier head configured to hold the substrate and press the substrate against the polishing pad;

a retaining ring adapted to be attached to and detached from the carrier head, wherein the retaining ring is configured to receive the substrate while detached from the carrier head; and a ring holder configured to hold the retaining ring while the retaining ring is detached from the carrier head.

2. The apparatus of claim 1, wherein the ring holder is further configured to apply downwardly pressure on the retaining ring.

3. The apparatus of claim 1, wherein the carrier head comprises at least two dowel pins configured to be inserted in the retaining ring to engage the retaining ring.

4. The apparatus of claim 3, wherein the at least two dowel pins are horizontally oriented and the retaining ring has at least two slots corresponding to the at least two dowel pins.

5. The apparatus of claim 3, wherein the at least two dowel pins are vertically oriented and the retaining ring has at least two apertures corresponding to the at least two dowel pins.

6. A method for polishing a substrate, comprising:

holding a retaining ring on a rotating polishing pad with a ring holder while the retaining ring is detached from a carrier head;

positioning the substrate into a recess defined by the retaining ring and the polishing pad;

securing the retaining ring to a carrier head to place the substrate on a substrate mounting surface of the carrier head; and then rotating the carrier head to polish the substrate against the polishing pad.

7. The method of claim 6, wherein securing the retaining ring to the carrier head comprises applying a pressure between the carrier head and an upper surface of the retaining ring.

8. The method of claim 6, wherein securing the retaining ring to the carrier head comprises inserting at least two dowel pins extending from the carrier head to the retaining ring.

9. The method of claim 8, wherein the at least two dowel pins are horizontal and configured to pick up the retaining ring when the carrier head is raised.

10. The method of claim 6, further comprising:

after polishing, moving the carrier head to remove the substrate from the polishing pad; and unloading the substrate from the substrate mounting surface of the carrier head.

11. The method of claim 6, further comprising:

after polishing, moving the carrier head to remove the substrate and the retaining ring from the polishing pad.

12. A method for loading a substrate on a carrier head, comprising:

positioning a retaining ring on a supporting surface using a ring holder while the retaining ring is detached from the carrier head;

positioning the substrate into a recess defined by the retaining ring and the supporting surface; and then securing the carrier head to the retaining ring to position the substrate on a substrate mounting surface of the carrier head.

13. The method of claim 12, wherein the supporting surface is a polishing pad.

14. The method of claim 12, wherein securing the carrier head to the retaining ring comprises engaging the carrier head and the retaining ring by at least one of a pressure, frictional, dowel pin inserting or electromagnetic approach.

15. The method of claim 12, further comprising aligning the retaining ring using an inner surface of an outer ring extended from the carrier head.

16. An apparatus for polishing a substrate, comprising:

a platen having a polishing pad supported thereon;

a carrier head configured to hold the substrate and press the substrate against the polishing pad; and a retaining ring adapted to be attached to and detached from the carrier head, wherein the retaining ring is configured to receive the substrate while detached from the carrier head, and the carrier head comprises at least two dowel pins configured to be inserted in the retaining ring to engage the retaining ring.

17. The apparatus of claim 16, wherein the at least two dowel pins are horizontally oriented and the retaining ring has at least two slots corresponding to the at least two dowel pins.

18. The apparatus of claim 16, wherein the at least two dowel pins are vertically oriented and the retaining ring has at least two apertures corresponding to the at least two dowel pins.

19. A method for polishing a substrate, comprising:

positioning a detached retaining ring on a polishing;

positioning the substrate into a recess defined by the retaining ring and the polishing pad;

securing the retaining ring to a carrier head to place the substrate on a substrate mounting surface of the carrier head; and then rotating the carrier head to polish the substrate against the polishing pad, wherein securing the retaining ring to the carrier head comprises inserting at least two dowel pins extending from the carrier head to the retaining ring.

20. The method of claim 19, wherein the at least two dowel pins are horizontal and configured to pick up the retaining ring when the carrier head is raised.

* * * * *

UNITED STATES PATENT AND TRADEMARK OFFICE

CERTIFICATE OF CORRECTION

PATENT NO. : 7,210,991 B1
APPLICATION NO. : 11/396839
DATED : May 1, 2007
INVENTOR(S) : Van Der Veen et al.

It is certified that error appears in the above-identified patent and that said Letters Patent is hereby corrected as shown below:

In the Claims:

In Column 12, Claim 14, Line 3, please delete "pressure" and insert --pressurizing--.

Signed and Sealed this

Seventeenth Day of July, 2007

JON W. DUDAS
*Director of the United States Patent and Trademark Office*